US005289771A

United States Patent [19]

Richter et al.

[11] Patent Number: 5,289,771

[45] Date of Patent: Mar. 1, 1994

[54] SHIFTABLE INK KNIFE HOLDER

[75] Inventors: Walter Richter, Grossrinderfeld; Kurt J. Weschenfelder, Zell a. Main, both of Fed. Rep. of Germany

[73] Assignee: Koenig & Bauer Aktiengesellschaft, Wurzburg, Fed. Rep. of Germany

[21] Appl. No.: 16,284

[22] Filed: Feb. 11, 1993

[30] Foreign Application Priority Data

Feb. 11, 1992 [DE] Fed. Rep. of Germany ..... 4203933

[51] Int. Cl.[5] ..... B41F 31/04; B41F 31/08

[52] U.S. Cl. ..... 101/350; 101/365

[58] Field of Search ..... 101/365, 167, 169, 366, 101/349, 351, 352, 363, 207-210, 350; 118/261

[56] References Cited

U.S. PATENT DOCUMENTS 3,921,525 11/1975 D'Amato et al. .

FOREIGN PATENT DOCUMENTS 0435817 10/1990 European Pat. Off. .
843553 7/1952 Fed. Rep. of Germany .
1097453 4/1956 Fed. Rep. of Germany .
233734 3/1986 Fed. Rep. of Germany .
4012949 4/1990 Fed. Rep. of Germany .
605092 12/1944 United Kingdom .

*Primary Examiner*—J. Reed Fisher
*Attorney, Agent, or Firm*—Jones, Tullar & Cooper

[57] ABSTRACT

A shiftable ink knife holder supports a plurality of spaced ink knives in an elongated support. The support is rotatable about an axis of rotation between working and rest positions. The rotation of the support can be accomplished by suitable drive motors. These drive motors also engage and disengage locking bolts that, in their locked position, engage the support.

13 Claims, 4 Drawing Sheets

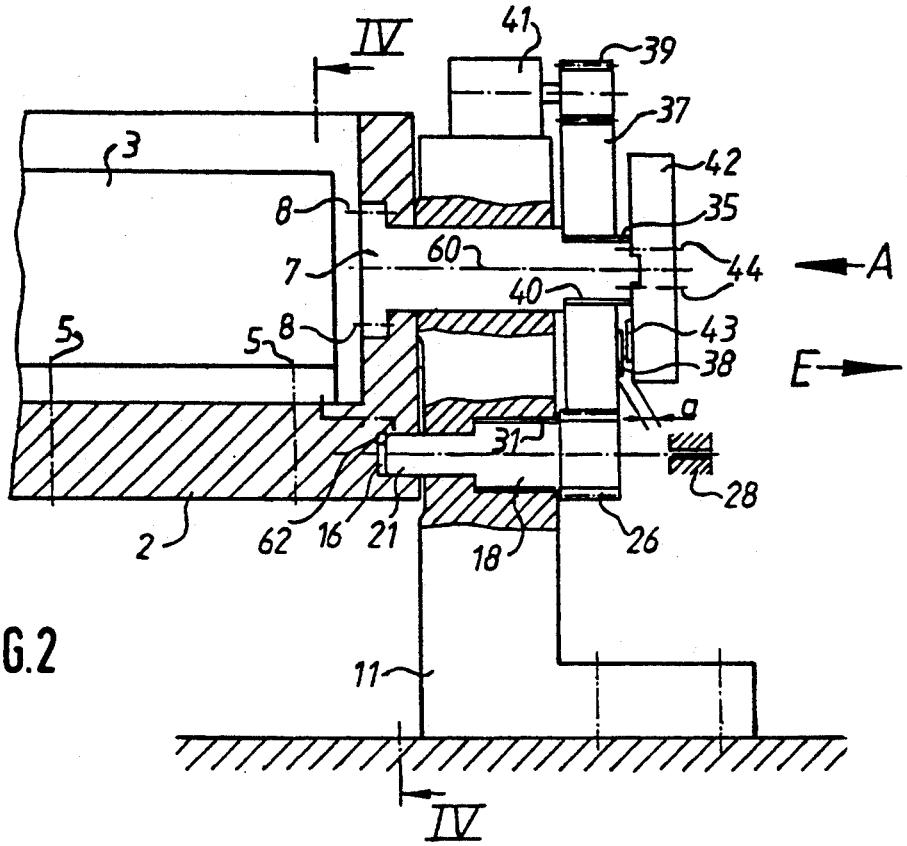
FIG.2
FIG.4
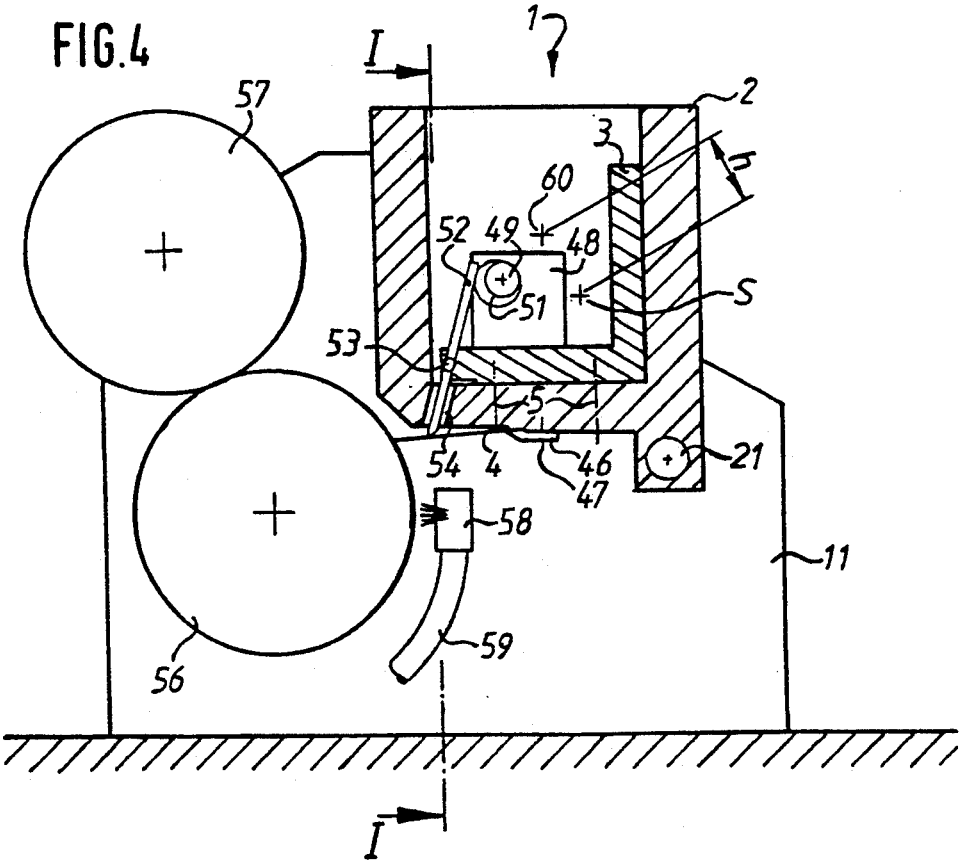

SHIFTABLE INK KNIFE HOLDER

FIELD OF THE INVENTION

The present invention is directed generally to a shiftable ink knife holder. More particularly, the present invention is directed to a shiftable ink knife holder for a rotary printing press. Most specifically, the present invention is directed to a shiftable ink knife holder for a rotary printing press in which the ink knife can be moved into and out of cooperative engagement with an ink fountain roller. The shiftable or pivotable ink knife holder supports a plurality of individual ink knives which are each separately provided with their own positioning motor and pivotable adjusting lever. The plurality of individually adjustable ink knives are supported by the pivotable or shiftable ink knife holder so that once the individual ink knives have all been properly adjusted with respect to their individual sections of the ink fountain roller, the entire ink knife holder can be shifted or pivoted as a unit to facilitate cleaning while retaining the individual ink knives in their adjusted positions.

DESCRIPTION OF THE PRIOR ART

It is generally known in the art to effect the metering of an ink supply in offset printing presses by the use of ink metering elements such as ink knives in an ink fountain. These ink metering elements cooperate with an ink fountain roller to control or meter the amount of ink that is allowed to be maintained on the surface of the ink fountain roller. The ink profile on the ink fountain roller, or on various portions of the ink fountain roller along its length, is the result of the positioning of the ink metering elements such as the ink knives in relation to the ink fountain roller.

It is important, in order to maintain the best possible reproducibility of ink films on the ink fountain roller, that the position of the ink fountain with respect to the ink fountain roller be maintained as exactly as possible. It is also necessary that the ink fountain be mounted so that it can be thrown-off or moved away from the ink fountain roller for cleaning and adjustment purposes. These cleanings and adjustments are necessary to ensure good operation of the rotary press but in the past have caused the previously adjusted position of the ink fountain with regard to the ink fountain roller to come out of adjustment.

In the prior German patent specification No. 40 12 949 there is shown an ink metering device having a pivotable or movable ink fountain. The ink fountain is movable by supporting rolls on a roller race to a stop position after which the ink fountain can then be swivelled or pivoted out of position for cleaning. After the cleaning has been accomplished and after the ink fountain has been swivelled or pivoted back into position with respect to the ink fountain roller, a plurality of pivotable or swivellable bows with cam rolls are applied against the circumference of the ink fountain roller to lock the ink fountain, in which the cam rolls run, onto the ink fountain roller.

A limitation of this prior art device is that the locking of the ink fountain is accomplished by a spring force utilizing the swivellable bow and cam rollers. The swivellable bow is subject to tension variations and is rolling on the ink fountain roller as it operates. This allows there to be formed dirt deposits between the ink fountain roller and the cam rollers of the swivelling bow.

These dirt deposits can cause variations of the impression pressure of the ink fountain with respect to the ink fountain roller. These variations in impression pressure result in variations in the thickness of the applied ink film on the ink fountain roller.

A further limitation of this prior art device is that the swivelling movement of the ink fountain roller is accomplished manually. This manual adjustment, which is usually accomplished by a helper and not a skilled press operator, is apt to result in adjustment errors caused by individual operating faults.

It will be apparent that a need exists for a swivellable ink knife holder for a rotary press which overcomes the limitations of the prior art devices. The shiftable ink knife holder of the present invention provides such a device and is a significant improvement over the prior art devices.

SUMMARY OF THE INVENTION

It is an object of the present invention to provide a shiftable ink knife holder.

Another object of the present invention is to provide a shiftable ink knife holder for a rotary press.

A further object of the present invention is to provide a shiftable ink knife holder that is movable into and out of cooperation with an ink fountain roller.

Still another object of the present invention is to provide a shiftable ink knife holder which is shiftable out of and back into its working position with respect to an ink fountain roller accurately and automatically.

Yet a further object of the present invention is to provide a shiftable ink knife holder that supports a plurality of individually adjustable ink knives.

As will be discussed in detail in the description of the preferred embodiment which is set forth subsequently, the swivellable or shiftable ink knife holder in accordance with the present invention utilizes an elongated housing which carries a plurality of individually adjustable ink knives that are used to control the thickness of the layer of ink which is applied to the ink fountain roller by a suitable ink supply assembly. The elongated housing is supported at its ends on axle trunnions in bearing brackets. A locking bolt extends through each of the bearing brackets and into a locking bore in each of the end faces of the housing. Each of these locking bolts is retractable out of its locking bore by actuation of a drive motor. Once the two locking bolts have been retracted, one of the drive motors is used to rotate the housing about its rotational axis so that the individual ink knives will be moved away from the ink fountain roller. Once the housing has been thrown-off the ink fountain roller, it can be cleaned and the like. The drive motors are then reversed and are used to return the housing to its operating position and to reinsert the locking bolts into their locking bores. Since the individual ink knife blades have not been shifted or moved with respect to the ink knife holder housing, they remain in proper adjustment with respect to the ink fountain roller.

The shiftable ink knife holder of the present invention is moved by automatically operable gear motors between its thrown-on and thrown-off positions. There is no possibility that operator error can result in the ink knife holder being returned to its operative position with respect to the ink fountain roller in an other than properly adjusted position. Only a small expenditure of force and hence only a small drive motor is required to accomplish the shifting of the ink knife holder. This is because the rotational center line of the holder, which passes through the axle trunnions that support the holder, is quite near to the center of gravity of the assembly.

A further benefit of the shiftable ink knife holder of the present invention is that since electric motors and switches are used to move the locking bolts and to rotate the shiftable ink knife holder, it is not possible to operate the rotary press unless the holder is in its proper position. This ensures that the press will not operate if the shiftable ink knife holder is not properly positioned for operation.

Another advantage of the shiftable ink knife holder of the present invention is its ability to support several individually adjustable ink knives. For example, four such individual ink knives and their individual operating devices can be secured to the ink knife holder. This will allow the expeditious removal and exchange of any one of the individual ink knives, if necessary.

The shiftable or swivellable ink knife holder of the present invention successfully overcomes the limitations of the prior art devices. It accordingly is a substantial advance in the art.

BRIEF DESCRIPTION OF THE DRAWINGS

While the novel features of the shiftable ink knife holder of the present invention are set forth with particularity in the appended claims, a full and complete understanding of the invention may be had by referring to the detailed description of the preferred embodiment as is set forth subsequently, and as illustrated in the accompanying drawings, in which:

FIG. 2 is an enlarged side elevation of a right side of the shiftable ink knife holder and showing a drive portion of the holder;

FIG. 4 is a cross-sectional view of a shiftable ink knife holder taken along line IV—IV of FIG. 2;

DESCRIPTION OF THE PREFERRED EMBODIMENT

Figure 1:
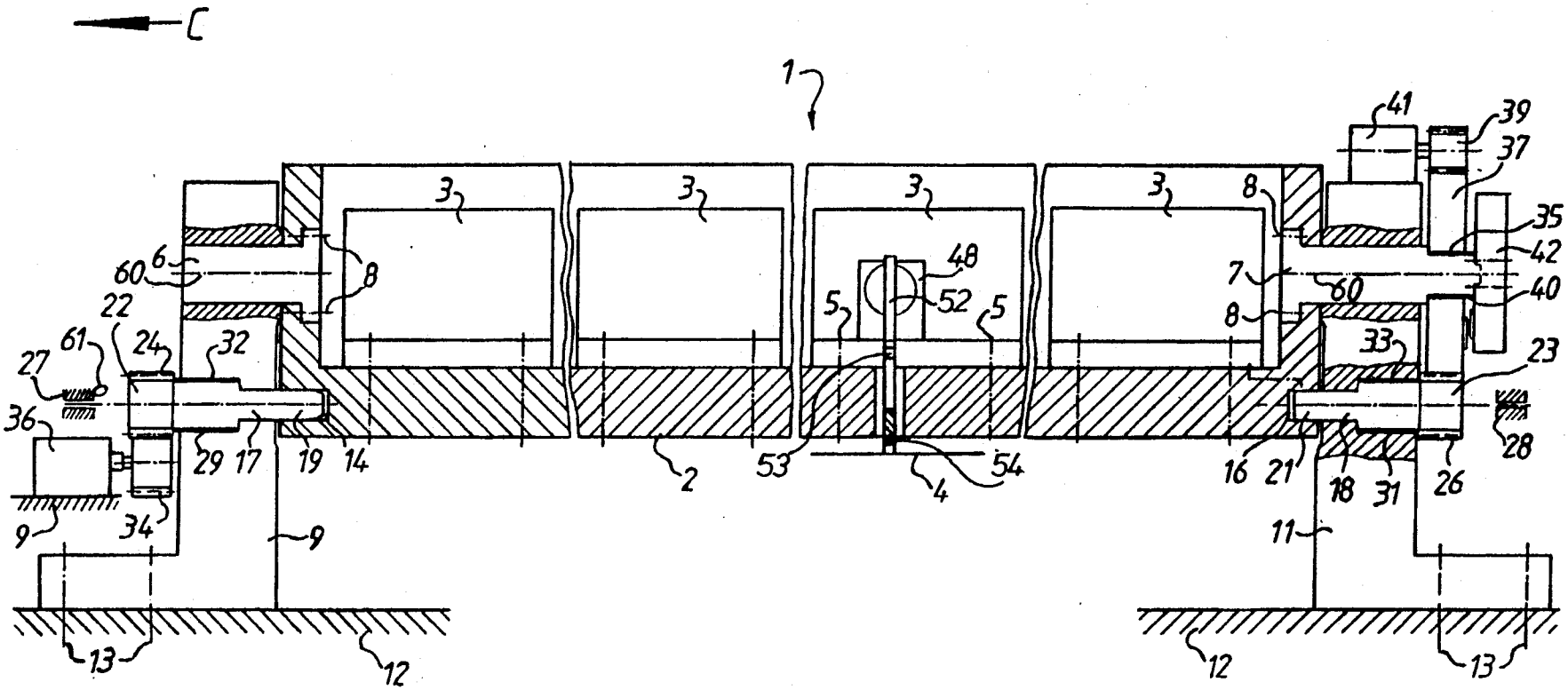
FIG. 1 is a side elevation view, partly in section, and taken along line I—I of FIG. 4, of a preferred embodiment of a shiftable ink blade holder in accordance with the present invention.

Referring initially to FIG. 1, there may be seen generally at 1 a preferred embodiment of a shiftable or swivellable ink knife holder for a rotary printing press in accordance with the present invention. Since the rotary printing press is generally conventional and well known, it will not be discussed in detail. The shiftable ink knife holder 1 of the present invention includes an elongated, generally trough-shaped housing 2, which, as may be seen in FIGS. 1, 4, and 7 supports a plurality of individual ink knife holding devices 3. In the preferred embodiment there are provided four such ink knife holding devices 3 with each of these supporting and providing adjustment means for an individual ink knife 4. These individual ink knife holding devices 3 are secured to the bottom of the housing 2 by suitable screws or similar fasteners 5, as may be seen in FIG. 1. As may be seen in FIG. 4 the several individual ink knives 4 cooperate with an ink fountain roller 56 as will be discussed in detail subsequently. Each ink knife 4 is individually adjustable in the housing 2 by means of its own adjustment drive motor 48, as will also be discussed in detail subsequently.

Referring again to FIG. 1, the housing 2 of the shiftable ink knife holder, generally at 1, is provided with axially outwardly extending axle trunnions 6 and 7 at its opposing end faces. These axle trunnions 6 and 7 are secured to the end faces of the housing 2 by suitable screws 8. The axle trunnions 6 and 7 are rotatably supported in bearing brackets 9 and 11 which are, in turn attached to a tie bar 12 by means of suitable fasteners, such as screws 13. The tie bar 12 is connected to side plates (not shown) of the machine frame of the rotary printing press.

Figure 5:
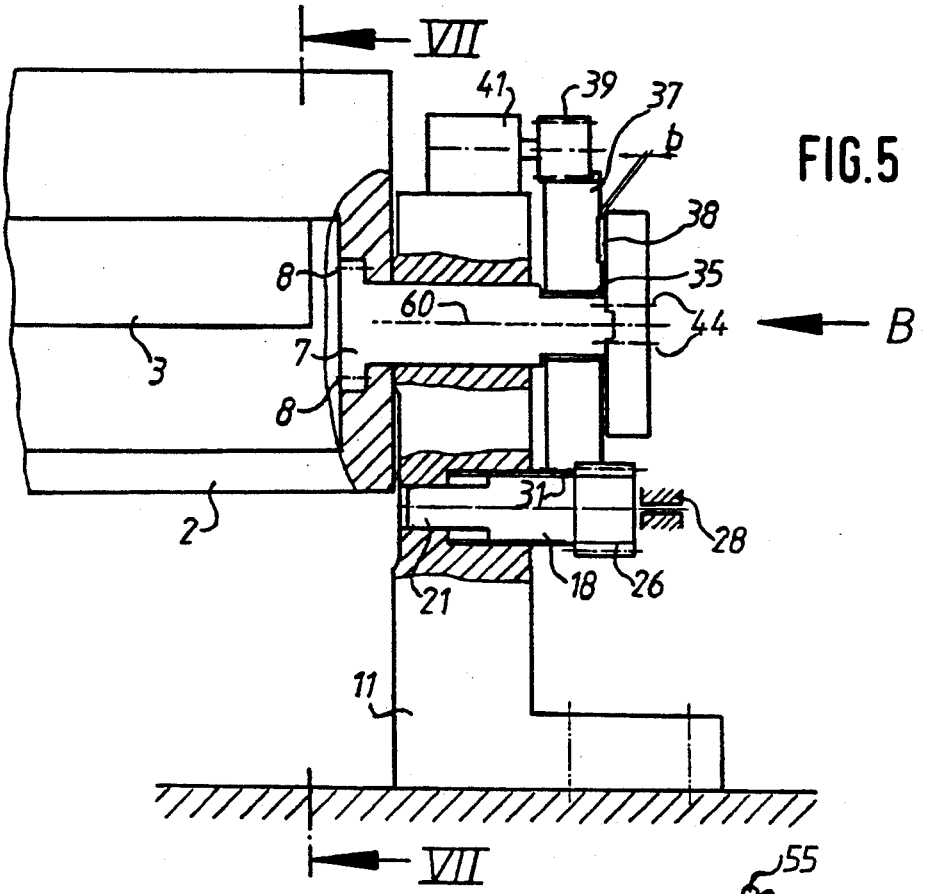
FIG. 5 is a view generally similar to FIG. 2 and showing the ink knife holder in a thrown-off and unlocked position.

Again referring to FIG. 1, and also to FIGS. 2 and 5, the end faces of the housing 2 of the shiftable ink knife holder 1 are provided with locking bores 14 and 16. These locking bores 14 and 16 are sized and positioned to be able to receive first ends 19 and 21 of axially shiftable locking bolts 17 and 18, respectively. These locking bolts 17 and 18 are provided with externally threaded intermediate portions 29 and 31 that are received in threaded tap holes 32 and 33 in the bearing brackets 9 and 11, respectively. Second ends of locking bolts 17 and 18, which are located exteriorly of bearing brackets 9 and 11, are provided with toothed gears 24 and 26. Extensions which project axially outwardly away from gears 24 and 26 of locking bolts 17 and 18 are supported in outboard bearings 27 and 28 that are also secured to the bearing brackets 9 and 11.

As is shown in FIG. 1, the gear 24 on the seoond end of the locking bolt 17 is in engagement with a drive gear 34 that is directly connected to a drive shaft of an electric or similar motor 36 which is secured to the bearing bracket 9. As may also be seen in FIG. 1, and as is further shown in FIGS. 2 and 5, the gear 26 on the second end of the locking bolt 18, which is supported in bearing bracket 11, meshes with a larger gear 37 that is provided with internal threads 35 in a central aperture or hub. These internal threads 35 engage exterior screw threads 40 on the portion of the axle trunnion 7 which is exterior of the bearing bracket 11. An external fixed stop or projection 38 is provided on the outer side face of the larger gear 37, as will be discussed shortly. A drive gear 39 is in engagement with the larger gear 37 and this drive gear is positively attached to the drive shaft of a second electric or similar motor 41. This motor 41 is secured to the bearing bracket 11.

The outer end of the axle trunnion 7 supports a disk 42 with this disk being connected to the end of the axle trunnion by suitable screws 44, as shown in FIGS. 2 and 5. The disk 42 is attached by the screws 44 to the outer end of the axle trunnion 7 exteriorly of the larger gear 37 which meshes with the second, gear end 26 of the second locking bolt 18. An inner surface of the disk 42 carries a stop or projection 43. This stop or projection 43 is located so that it can cooperatively engage the similarly shaped stop or projection 38 on the outer surface of the larger gear 37.

Figure 7:
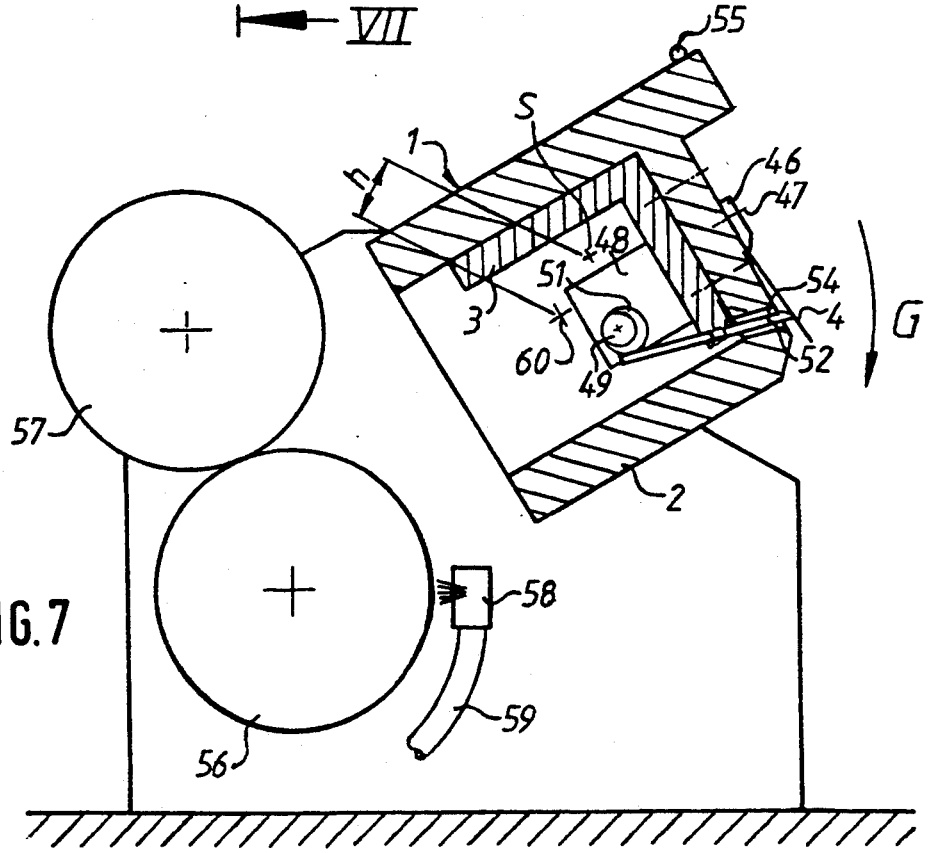
FIG. 7 is a cross-sectional view of the shiftable ink knife holder taken along line VII—VII of FIG. 5.

Turning now to FIG. 1 and taken in conjunction with FIGS. 4 and 7, each of the plurality of ink knife holding devices 3 which are secured to the bottom of the housing 2 is engageable with an ink knife 4 that is secured at one end in a generally cantilever manner to the outer surface of the bottom of the housing 2 of the shiftable ink knife holder Each of the ink knife holding devices 3 is equipped with one or more adjusting units, in accordance with the overall length of the printing press. In the subject invention, each adjusting unit is depicted as a motor 48 which is secured to the base of the holding device 3, that is, in turn, attached to the bottom of the housing 2 by the screws 5. The adjusting motor 48 has a drive shaft 49 which, as is shown in FIG. 4, is provided with an eccentric disk 51. This eccentric disk 51 is in contact with a first end of a lever arm 52 that is pivotably supported intermediate its ends at a pivot point 53 on the base of the ink knife holding device 3. A second end of the lever arm 52 passes through a bore 54 in the housing 2 and bears against an upper surface of the ink knife 4 intermediate its point of attachment to the bottom of housing 2 and its free end which cooperates with the ink fountain roller 56. The exact position of the holding devices 3 in the housing 2 are dictated by suitable stops which are not specifically shown.

As may be seen most clearly in FIG. 4, each ink knife 4 cooperates with the ink fountain roller 56 to control the thickness of the ink on the ink fountain roller or ink duct roller 56 which is, in contact at its periphery with a film roller 57. An inking bar 58 is in connection with an ink supply at 59 that receives ink from an ink reservoir which is not specifically depicted in the drawings. The ink fountain roller 56 and the film roller 57 are rotatably supported on both sides in the bearing brackets 9 and 11. As may be seen in FIG. 1, in the shiftable ink knife holder of the present invention there are provided four ink knife holding and adjusting devices 3 with each ink knife 4 effecting one quarter of the length of the ink fountain roller 56.

The operation of the shiftable ink knife holder in accordance with the present invention will now be discussed in detail. The ink knife holder 1 is initially in the working or operating position as depicted in FIGS. 1 to 4, so that the ink knife 4 is in contact with the ink, applied by the inking bar 58, on the duct roller 56. A signal is given from a central point, such as from a not represented control stand, to throw-off the ink knife holder 1. The motor 36 for the first locking bolt 17 receives an impulse and is initiated to a rotary movement so that the gears 34 and 24 mesh with each other and thus the locking bolt 17 rotates in the tap hole 32 and, due to its outside screw thread 29, moves in the direction of arrow C to a retracted position in which its first end 19 has been withdrawn from the locking bore 14 in the end face of the housing 2. As the locking bolt 17 is withdrawn out of the locking bore 14, a switch 61 is actuated. This switch 61 stops the motor 36 for the first locking bolt 17 and actuates the motor 41 for the second locking bolt 18 so that the gear 39 will be caused to rotate.

Figure 3:
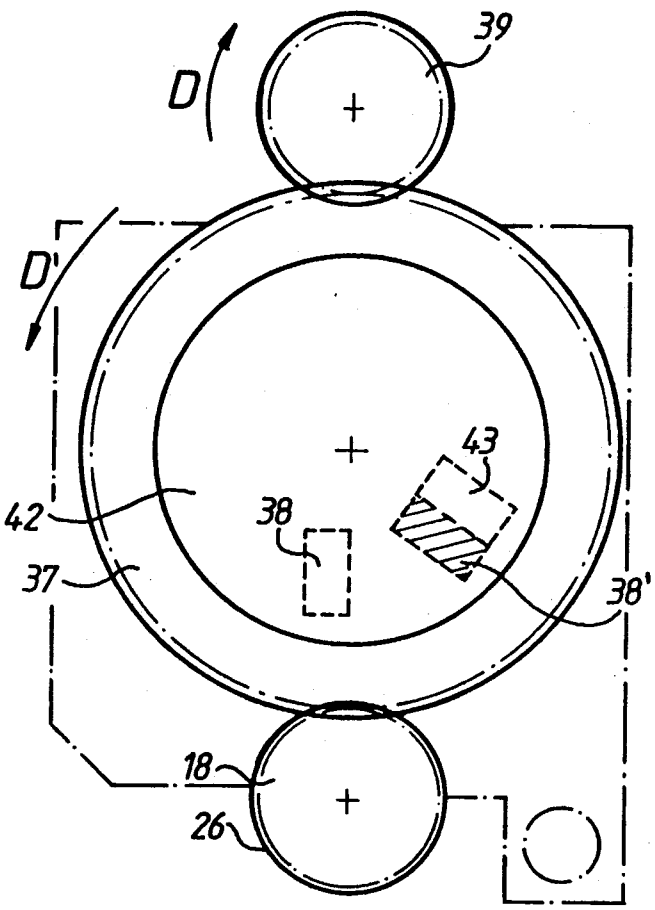
FIG. 3 is a schematic end view of the drive portion of FIG. 2 taken in the direction indicated by arrow A in FIG. 2.

The starting position of the second locking bolt 18 is as represented in FIGS. 2 and 4. By rotating the gear 39, arranged on the shaft of the motor 41 in the direction of arrow D, as shown in FIG. 3, the gear 37 with its stop 38 is caused to make a corresponding rotary movement. As shown in FIG. 2 the gear 37 is initially at a first distance "a" from the disk 42, so that the stop 38 passes the stop 43. Since the hub of the gear 37 is connected with the internal thread 35, the gear 37 moves in the direction of arrow E as shown in FIG. 2, so that the distance "a" diminishes and the stop 38 comes to an abutting position against the stop 43 after a significant revolution of the gear 37. This is shown by the hatched representation of the stop 38 at position 38' in FIG. 3. This large or significant amount of revolution of the gear 37, which is in the order of 1.2 revolutions, is sufficient to retract the first end 21 of the second locking bolt 18 out of the locking bore 16 in the second end of the support housing 2 of the shiftable ink knife holder 1. This is due to the cooperation between the external threads 31 on the locking bolt 18 with the tapped hole 33 in the bearing bracket 11. The gear head 26 of the second locking bolt 18 is turned through approximately six revolutions.

Figure 6:
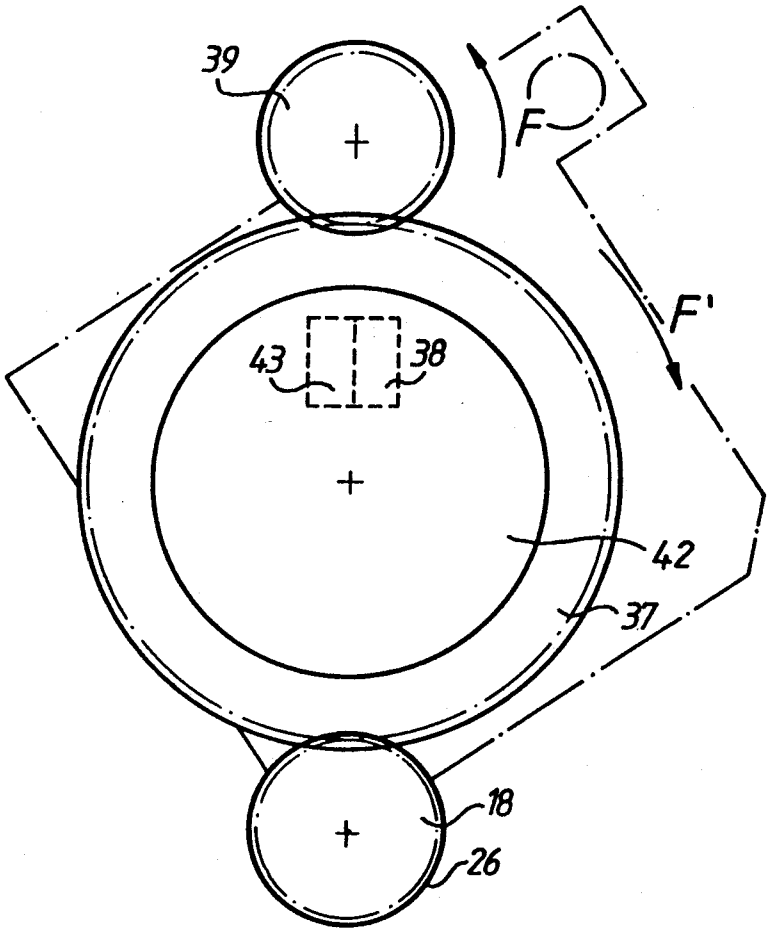
FIG. 6 is a schematic end view generally similar to FIG. 3, taken in the direction indicated by the arrow B in FIG. 5 and showing the drive in the thrown-off position.

Once the two stops 38 and 43 are in contact with each other as a result of the axially outward movement of the gear 37 on the axle trunnion 7 during the approximately 1.2 revolutions of the gear 37 that is required to extract the first end 21 of the second locking bolt 18 from the locking bore, the gear wheel 37 is allowed to turn through approximately another 0.3 revolutions in the direction of arrow D' and to thereby reach the position shown in FIG. 6. As the stop 43, which is fixedly connected with the housing 2 through the axle trunnion 7 and the disk 42, is also moved, there is effected a rotational movement of the ink knife housing 2 around its swivelling axis 60. The ink knife holder 1 has now moved to its thrown-off position as shown in FIGS. 5 and 7. The motor 41 switches off when the ink knife holder 1 moves against a switch 55 which is shown in FIG. 7. The distance "a" between the gear 37 and the disk 42 of FIG. 3 has diminished to a distance "b" shown in FIG. 5. Now, the ink knives 4 can easily be cleansed and if needed, the inking bar 58 as well can also be cleaned. It will be noted that this shifting or swivelling of the housing 2 has not effected the positions of the ink knives 4 with respect to the housing 2.

The throwing-on or shifting of the shiftable ink knife holder 1 of the present invention from its cleaning or rest position, as depicted in FIG. 7 to its operating position as depicted in FIG. 2, is accomplished in the following manner. The motor 41 receives an impulse from a central point and starts up. Thus, the gear 39 rotates in the direction of arrow F as seen in FIG. 6. The gear 37 having the stop 38, and meshing with the gear 39, rotates as well but in the direction of arrow F'. The stop 43 on the disk 42, which is in contact with the stop 38, follows the same in the direction of arrow F', since the rotational axis 60 of the housing 2 is so near, at a distance "h" of, for example ten millimeters from the center of gravity S of the ink knife holder 1, that the part of the ink knife holder 1, carrying the holding devices 3 and their drive means, has a slight overweight, so that the ink knife holder 1, as seen in FIG. 7 is predisposed to automatically execute a swivelling or rotational movement in the direction of arrow G, as shown in FIG. 7. Thus, the ink knife holder 1 shifts out of its rest position, represented in FIG. 7 in the direction of arrow G to the use position shown in FIG. 4. This means that the center of gravity S travels from the 1st to the 4th quadrant, referring to a coordinate system the point of origin of which is on the axis of rotation 60 of the ink knife holder 1.

When both stops 38; 43 have jointly made approximately 0.3 revolution, the ink knife holder 1 has rotated back into the working position against a suitable stop which is not specifically shown. The stops 38 and 43 now reach the position 43 and 38' shown to FIG. 3. The disk 42 with the stop 43 stops, and the gear 37 with the stop 38 still rotates 1.2 revolutions with, ater one revolution, the stops 38 and 43 passing each other at the distance "a" which is shown in FIG. 2. This rotation of the gear 37 through its 1.2 revolutions is sufficient to cause the second locking bolt 18 to move axially inwardly in bearing bracket 11 so that its inner end 21 again is received in locking bore 16. As may be seen in FIG. 2, a switch 62 is provided in the inner end of locking bore 16 so that once the first or inner end 21 of the second locking bolt 18 has been turned into the bore 16, it will engage the switch 62 and will stop the drive motor 41 for gear 39 and will concurrently activate the motor 36 for the first locking bolt 17 which will be rotated so that its first, inner end is reinserted in locking bore 14.

As was discussed above, the various ink knives 4 are not shifted relative to the housing 2 during the movement of the shiftable ink knife holder 1 between its work and rest positions. This means that these ink knives 4 do not have to be repositioned each time the housing 2 is shifted. If desired, the various adjusting motors 48 on the holding devices 3 can be preadjusted in an unmounted position and then secured to the bottom portion of the housing 2.

While a preferred embodiment of a shiftable ink knife holder in accordance with the present invention has been set forth fully and completely hereinabove, it will be apparent to one of skill in the art that a number of changes in, for example, the overall size of the holder, the type of ink used, the type of drive motor used and the like can be made without departing from the true spirit and scope of the present invention which is accordingly to be limited only by the following claims.

What is claimed is:

1. A shiftable ink knife holder for a rotary printing press having an ink fountain roller, said shiftable ink knife holder comprising:

an elongated ink knife support housing;

a plurality of ink knife blades adjustably supported along said support housing;

first and second axle trunnions secured to spaced, opposing first and second end faces of said support housing and supporting said housing for rotation about a center line extending through said axle trunnions;

spaced first and second bearing brackets receiving said first and second axle trunnions and rotatably supporting said housing;

means for rotating said support housing between a thrown-on and a thrown-off position with respect to an ink fountain roller; and means for locking said support housing in said thrown-on position, said means for locking said support housing in said thrown-on position including first and second locking bolts secured to said spaced first and second bearing brackets, said first and second locking bolts each having a first end receivable in a locking bore in said first and second end faces of said support housing.

2. The shiftable ink knife holder of claim 1 wherein said support housing has a center of gravity which is offset with respect to said center line to render said support housing top heavy in said thrown-off position.

3. The shiftable ink knife holder of claim 1 wherein second ends of said first and second locking bolts are provided as gears.

4. The shiftable ink knife holder of claim 3 wherein each of said locking bolts has an externally threaded portion intermediate its first and second ends and further wherein said exteriorly threaded portion is received in a threaded tap hole in a corresponding one of said first and second bearing brackets.

5. The shiftable ink knife holder of claim 4 further including a first motor driven gear in engagement with said second end of said first locking bolt.

6. The shiftable ink knife holder of claim 5 including a gear wheel in engagement with said second end of said second locking bolt and further including a second motor driven gear in engagement with said gear wheel.

7. The shiftable ink knife holder of claim 6 further including a disk secured to an end of said second axle trunnion, said disk having a drive pin which is selectively engageable with said gear wheel.

8. The shiftable ink knife holder of claim 7 wherein said gear wheel is supported for axial movement on said second axle trunnion intermediate said second bearing bracket and said disk.

9. The shiftable ink knife holder of claim 8 wherein said gear wheel has an internally threaded central hole which is in engagement with an external screw thread on said second axle trunnion.

10. The shiftable ink knife holder of claim 8 wherein each of said plurality of adjustably supported ink knife blades is provided with an adjusting device.

11. The shiftable ink knife holder of claim 10 wherein each of said adjusting devices includes an adjusting drive motor.

12. The shiftable ink knife holder of claim 11 wherein a pivotable lever extends between each one of said adjusting drive motors and a corresponding ink knife blade.

13. The shiftable ink knife holder of claim 1 further including an ink fountain roller and a cooperating film roller and wherein said ink fountain roller and said cooperating film roller are supported for rotation between said first and second bearing brackets.

* * * * *